US007838754B2

(12) United States Patent
Usa

(10) Patent No.: US 7,838,754 B2
(45) Date of Patent: Nov. 23, 2010

(54) PERFORMANCE SYSTEM, CONTROLLER USED THEREFOR, AND PROGRAM

(75) Inventor: Satoshi Usa, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 911 days.

(21) Appl. No.: 11/686,559

(22) Filed: Mar. 15, 2007

(65) Prior Publication Data

US 2007/0214946 A1 Sep. 20, 2007

(30) Foreign Application Priority Data

Mar. 16, 2006 (JP) ..... 2006-073063

(51) Int. Cl.
*G04B 13/00* (2006.01)

(52) U.S. Cl. ..... 84/609; 84/610; 84/612; 84/634; 84/649; 84/650; 84/652

(58) Field of Classification Search ..... None
See application file for complete search history.

(56) References Cited

U.S. PATENT DOCUMENTS

| | | | | |
|---|---|---|---|---|
| 5,361,673 | A | 11/1994 | Kira et al. | |
| 7,247,784 | B2 * | 7/2007 | Muraki et al. | 84/609 |
| 7,579,543 | B2 * | 8/2009 | Haruyama et al. | 84/601 |
| 2002/0023529 | A1 * | 2/2002 | Kurakake et al. | 84/610 |
| 2003/0000369 | A1 * | 1/2003 | Funaki | 84/609 |
| 2004/0011190 | A1 * | 1/2004 | Kawashima | 84/645 |
| 2004/0069124 | A1 * | 4/2004 | Murakai et al. | 84/622 |
| 2005/0109195 | A1 * | 5/2005 | Haruyama et al. | 84/645 |
| 2008/0000344 | A1 * | 1/2008 | Komori et al. | 84/609 |

(Continued)

FOREIGN PATENT DOCUMENTS

JP 02-204794 8/1990

(Continued)

*Primary Examiner*—Marlon T Fletcher
(74) *Attorney, Agent, or Firm*—Harness, Dickey & Pierce, PLC

(57) ABSTRACT

A performance system capable of improving operability of switching local-on/off of performance terminals. T performance system comprises a performance terminal and a controller capable of communicating with each other. The performance terminal is comprised of a performance operation device, a tone generator, and a control device adapted to transmit performance data generated by the performance operation device to the controller, execute a communication process for inputting performance data received from the controller to the tone generator, and execute a mode switching process for switching between a local-on mode in which the performance operation device inputs the generated performance data to the tone generator to generate a tone and a local-off mode in which the performance operation device does not input the generated performance data to the tone generator. The controller is comprised of a storage device adapted to store musical piece data consisting of a plurality of performance data strings, and an automatic performance control device adapted to determine a tempo and/or a beat timing of automatic performance based on performance data received from the performance terminal, read out a performance data string from the musical piece data, and transmit the read-out performance data to the performance terminal. The automatic performance control device is adapted to transmit a local-off instruction message to the performance terminal upon commencement of automatic performance according to the musical piece data, and the control device is adapted to switch the mode to a local-off mode upon receiving the local-off instruction message from the controller.

6 Claims, 9 Drawing Sheets

U.S. PATENT DOCUMENTS

| | | | | |
|---|---|---|---|---|
| 2008/0127811 | A1* | 6/2008 | Ikeya | 84/610 |
| 2009/0249945 | A1* | 10/2009 | Yamashita et al. | 84/612 |

FOREIGN PATENT DOCUMENTS

| | | |
|---|---|---|
| JP | 06-102866 | 4/1994 |
| JP | 2002-333880 | 11/2002 |
| JP | 2004-287127 | 10/2004 |
| JP | 2006-039326 | 2/2006 |

* cited by examiner

FIG. 3

MUSICAL PIECE DATA
(CORRESPONDING TOONE MUSICAL PIECE)

| |
|---|
| PART ID1<br>(PART IDENTIFICATION INFORMATION) |
| DATA OF MUSICAL PIECE<br>TO BE PERFORMED<br>(PERFORMANCE INFORMATION) |
| PART ID2<br>(PART IDENTIFICATION INFORMATION) |
| DATA OF MUSICAL PIECE<br>TO BE PERFORMED<br>(PERFORMANCE INFORMATION) |
| ·<br>·<br>· |

FIG. 4

PART ASSIGNMENT TABLE

| TERMINAL ID | PERFORMANCE PART |
|---|---|
| 0 | F (FACILITATOR) |
| 1 | ACCOMPANIMENT 1 PART |
| 2 | ACCOMPANIMENT 2 PART |
| 3 | RHYTHM PART |
| 4 | ACCOMPANIMENT 3 PART |
| 5 | MELODY PART |

PERFORMANCE SYSTEM, CONTROLLER USED THEREFOR, AND PROGRAM

BACKGROUND OF THE INVENTION

1. Field of the Invention

The present invention relates to a performance system of controlling automatic performance by a performance terminal is controlled by a controller, a controller used therefor, and a program.

2. Description of the Related Art

Conventionally, a performance apparatus employing a method of switching local-on/off settings of a performance terminal is known. When the performance terminal is set to a local-on mode, tone data generated through playing operation is produced from a tone generator, and when the performance terminal is set to a local-off mode, generated tone data is not produced and MIDI signals are outputted to an external apparatus instead (for instance, refer to Japanese Patent Laid-Open No. 06-102866). When the local-on mode is set, the performance terminal may be used as an ordinary electronic musical instrument to be played in accordance with a user's playing operations. In addition, when the local-off mode is set, automatic performance may be performed by connecting the performance terminal to a controller that is a control device, and by controlling performance of the performance terminal through the controller. In the latter case, since tones in response to playing operations will not be produced, comfortable listening of automatic performance by the user will not be inhibited by such tone production.

In the above-described conventional art, switching of local-on/off settings is performed by the user by directly operating the performance terminal. Therefore, since the local-on/off settings of the performance terminal must be switched whenever performing or concluding automatic performance, user-operability of the performance terminal is poor.

Additionally, in a case where a plurality of performance terminals are connected to the controller to perform an ensemble, the failure of setting even one performance terminal to local-off mode will inhibit the performance. Thus, all performance terminals must be set to local-off mode. The fact that all performance terminals must be operated to switch their modes to local-off further complicates operations.

SUMMARY OF THE INVENTION

In order to solve the above problems, the present invention provides a performance system capable of improving operability of switching local-on/off of performance terminals, a controller used in the performance system, and a program therefor.

In a first aspect of the present invention, there is provided a performance system comprising a performance terminal and a controller capable of communicating with each other, wherein the performance terminal is comprised of: a performance operation device adapted to generate performance data according to operations of a performer; a tone generator adapted to generate a tone based on the performance data; and a control device adapted to transmit performance data generated by the performance operation device to the controller, execute a communication process for inputting performance data received from the controller to the tone generator, and execute a mode switching process for switching between a local-on mode in which the performance operation device inputs the generated performance data to the tone generator to generate a tone and a local-off mode in which the performance operation device does not input the generated performance data to the tone generator, the controller is comprised of: a storage device adapted to store musical piece data consisting of a plurality of performance data strings; and an automatic performance control device adapted to determine a tempo and/or a beat timing of automatic performance based on performance data received from the performance terminal, read out a performance data string from the musical piece data, and transmit the read-out performance data to the performance terminal, further wherein the automatic performance control device of the controller is adapted to transmit a local-off instruction message to the performance terminal upon commencement of automatic performance according to the musical piece data, and the control device of the performance terminal is adapted to switch the mode to a local-off mode upon receiving the local-off instruction message from the controller.

The automatic performance control device of the controller can be adapted to transmit a local-on instruction message to the performance terminal upon conclusion or termination of automatic performance according to the musical piece data, and the control device of the performance terminal can be adapted to switch the mode to a local-on mode upon receiving the local-on instruction message from the controller.

In a second aspect of the present invention, there is provided a controller capable of mutually communicating with a performance terminal, the controller comprising: a storage device adapted to store musical piece data consisting of a plurality of performance data strings; and an automatic performance control device adapted to determine a tempo and/or a beat timing of automatic performance based on performance data received from the performance terminal, read out a performance data string from the musical piece data, and transmit the read-out performance data to the performance terminal, wherein the automatic performance control device is adapted to transmit a local-off instruction message to the performance terminal upon commencement of automatic performance according to the musical piece data.

The automatic performance control device can be adapted to transmit a local-on instruction message to the performance terminal upon conclusion or termination of automatic performance according to the musical piece data.

In a third aspect of the present invention, there is provided a program that causes a controller which is equipped with a storage device for storing musical piece data consisting of a plurality of performance data strings, and is capable of mutually communicating with a performance terminal, to execute: an automatic performance process for determining a tempo and/or a beat timing of automatic performance based on performance data received from the performance terminal, reading out a performance data string from the musical piece data, and transmitting the read-out performance data to the performance terminal; and a local-off instruction process for transmitting a local-off instruction message to the performance terminal upon commencement of automatic performance according to the musical piece data.

The program can cause the controller to execute a local-on instruction process for transmitting a local-on instruction message to the performance terminal upon conclusion or termination of automatic performance according to the musical piece data.

In the above arrangements of the present invention, the tone generator generates tones according to a playing operation in the event that the tone generator is set to local-on mode when a playing operation is accepted at a performance terminal. Therefore, when the mode has not been switched to local-off mode, the performance terminal will produce a tone corresponding to an operation of an operating element by a user even when performance data is inputted from the controller that is controlling the performance terminal to perform automatic performance. Such tone production inhibits automatic performance by the controller.

According to the arrangements of the present invention, the controller causes the automatic performance control device to transmit a local-off instruction message to a performance terminal apparatus at the commencement of automatic performance according to musical piece data. When the local-off instruction message from the controller is received at the performance terminal apparatus, the control device switches the mode to local-off mode. This enables the mode to be automatically switched to the local-off mode upon commencement of automatic performance, and therefore improves operability of switching to the local-off mode. At the same time, since the user is no longer required to operate the performance terminal to switch the mode to local-off mode, it is now possible to prevent inhibition of automatic performance attributable to the user's neglect to perform the switching operation.

In addition, according to the arrangements of the present invention, the controller causes the automatic performance control device to transmit a local-on instruction message to a performance terminal apparatus at the conclusion of automatic performance according to musical piece data. When the local-on instruction message from the controller is received at the performance terminal apparatus, the control device switches the mode to local-on mode. This enables the mode to be automatically switched to the local-on mode upon conclusion of automatic performance, and therefore improves operability of switching to the local-on mode. At the same time, since the user is no longer required to operate the performance terminal to switch the mode to local-on mode, it is now possible to effectively prevent failure of tone production, which is attributable to the user's neglect to perform the switching operation, when a playing operation is performed by the user after conclusion of automatic performance.

According to the present invention, upon commencement of automatic performance, a performance terminal is automatically switched to the local-off mode, and switching to local-off mode may be performed with favorable operability when controlling performance of the performance terminal by the controller.

In addition, upon conclusion of automatic performance, the performance terminal is automatically set to the local-on mode, and switching to local-on mode may be performed with favorable operability when concluding performance control of the performance terminal by the controller.

As a result, since switching of local-on/off need not be performed whenever performance control of the performance terminal is commenced or concluded, thereby improving the user operability.

The above and other objects, features, and advantages of the invention will become more apparent from the following detailed description taken in conjunction with the accompanying drawings.

BRIEF DESCRIPTION OF THE DRAWINGS

FIG. 3 is a view showing an example of musical piece data.

FIG. 4 is a view showing a table that associates part IDs with MIDI ports.

DESCRIPTION OF THE PREFERRED EMBODIMENTS

A performance system 100 according to an embodiment of the present invention will now be described with reference to FIGS. 1 to 10.

Figure 1:
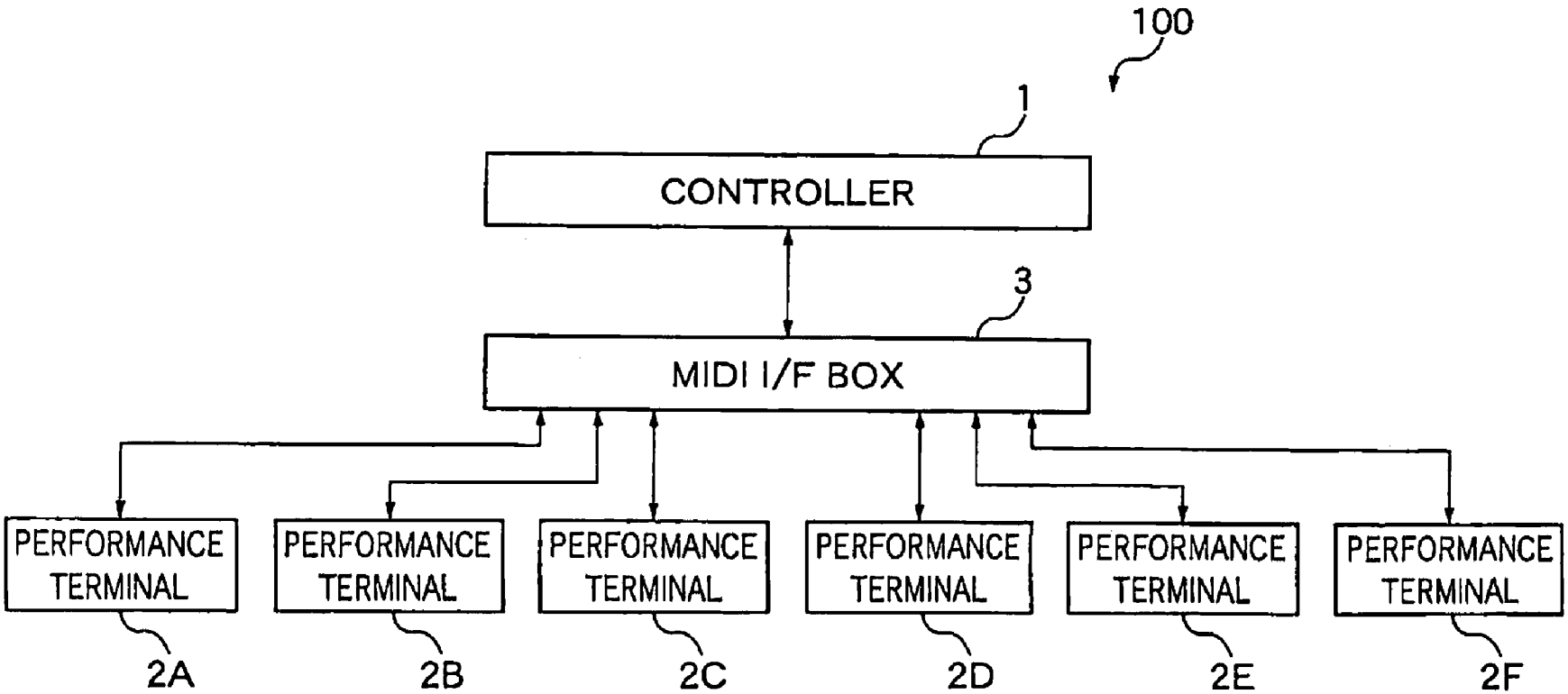
FIG. 1 is a block diagram showing an arrangement of a performance system according to an embodiment of the present invention.

FIG. 1 is a block diagram showing an arrangement of a performance system 100 according to an embodiment of the present invention. The performance system 100 comprises a controller 1, and a plurality (six in FIG. 1) of performance terminals 2 (2A to 2F) which are connected to the controller 1 via a MIDI interface box 3. For the performance terminals 2, electronic keyboard instruments such as electronic pianos are used.

In this embodiment, via the MIDI interface box 3, respective performance terminals 2 are connected to the controller 1 through different MIDI channels. The MIDI interface box 3 is connected to the controller 1 via USB.

Each of the performance terminals 2 may be used for performance (tone generation) according to the control of the controller 1, and may also be played according to playing operations performed by a performer by depressing keys outside of the control of the controller 1.

In the event that the performance terminals 2 are not set to local-off when performance is controlled by the controller 1, tones with tone pitches corresponding to the depression of keys by the performer will be generated by the tone generators of each of the performance terminals 2, thereby inhibiting performance controlled by the controller 1. Additionally, in the event that the performance terminals 2 are not set to local-on when performance control by the controller 1 is concluded, tones with tone pitches corresponding to the depression of keys by the performers will not be generated, thereby preventing the performance terminals 2 to be used as ordinary electronic musical instruments.

With the present embodiment, when the controller 1 accepts an operation instructing commencement of performance control of a selected musical piece, the controller 1 transmits a control signal (local-off instruction message) that sets the mode to local-off to each of the performance terminal 2. In addition, when receiving an operation instructing suspension of performance control or when performance control is concluded, the controller 1 transmits a control signal (local-on instruction message) that sets the mode to local-on to each of the performance terminal 2. As a result, performers of the respective performance terminals 2 will no longer be required to individually switch local-on/off settings of the performance terminals 2 upon commencement or conclusion of performance control of the performance terminals 2, and operability of switching local-on/off settings may be improved.

In particular, while the failure of setting even one performance terminal 2 to local-off mode will inhibit ensemble performance when performing an ensemble involving a plurality of the performance terminals 2, according to the present embodiment, switching of local-on/off settings of a plurality of the performance terminals 2 may be simultaneously performed in a convenient manner without having to bother each performer to operate switching.

With the performance system according to the present embodiment, when the controller 1 controls performance of the respective performance terminals 2, an ensemble is performed by having the respective performance terminals 2 perform a different performance part. More specifically, the controller 1 assigns different performance parts to the respective performance terminals 2A to 2F, and controls the respective performance terminals 2 so that tones are generated by the performance parts assigned thereto. In this description, the performance parts refer to respective melodies and the like that compose an ensemble, as described above. For example, the performance parts may include one or a plurality of melody parts, a rhythm part, and a plurality of accompaniment parts using different musical instruments.

Additionally, in the present embodiment, the controller 1 controls the respective performance terminals 2 so that semi-automatic performance is performed instead of automatic performance in which performance of the respective performance terminals 2 is controlled totally independent from playing operations. During semi-automatic performance, instead of having the respective performance terminals 2 perform fully-automatic performance (including performance tempo and performance timing), performance is also controlled by playing operations (such as an operation involving depressing any one of the keys of a keyboard) carried out by a performer on the respective performance terminals 2. More specifically, performance tempo and performance timing may be adjusted by adjusting the timing of playing operations.

An outline of adjustment of performance tempo and performance timing will now be described. Being keyboard instruments, each of the performance terminals 2 comprises keyboards having a plurality of keys (operating elements), and accept playing operations through the depression of such keys. Each of the performance terminals 2 are provided with functions to communicate with the controller 1, and send performance operation signals indicating operation information (MIDI data, note-on message) of playing operations to the controller 1.

While operation information includes information indicating tone pitch in addition to information indicating the timing of a playing operation, the controller 1 according to the present embodiment uses operation information as information indicating the timing of a playing operation by ignoring information indicating tone pitch. Therefore, regardless of which key is depressed, when the same key is depressed at the same timing and same tempo, the same playing operation signal will be transmitted to the controller 1. As a result, by merely depressing any one of the keys at a suitable timing, the performer may achieve suitable performance. Therefore, even a performer not accustomed to playing a keyboard instrument will be able to play a performance terminal.

The controller 1 is composed of, for instance, a personal computer, and controls performance operations of each of the performance terminal 2 by means of software installed in the personal computer. More specifically, the controller 1 stores musical piece data comprising a plurality of performance parts. Prior to commencement of an ensemble, the controller 1 respectively assigns a performance part (or a plurality of performance parts) to each of the performance terminal 2A to 2F. The controller 1 is provided with a function of communicating with each of the performance terminal 2, and determines tempo and timing of a performance part assigned to a performance terminal 2 based on operation information inputted from that performance terminal 2. The controller 1 then reads out performance data (MIDI data) corresponding to the part at the determined tempo and timing, and outputs the data to the performance terminal 2.

Each of the performance terminals 2 inputs performance data inputted from the controller 1 to an internal tone generator to generate a tone. This allows each of the performance terminals 2 to generate a tone at a tempo and timing instructed by each performer through a playing operation and in the performance part assigned by the controller 1, thereby causing an ensemble to be performed.

In the present embodiment, the timing required by a playing operation in order to perform an ensemble in a suitable manner is common to all performance parts. This playing timing is indicated to each performer by means of a playing operation by a facilitator (such as the performer of the performance terminal 2A) acting as a guide, or by conducting performed by the facilitator using a hand or the like. A suitable ensemble is achieved when each performer performs a playing operation (key depression) at the instructed playing timing.

The performance terminal 2 need not be limited to a keyboard instrument such as an electronic piano, and may alternatively be another electronic musical instrument such as an electronic guitar. It is also obvious that the exterior appearance of the performance terminal 2 need not resemble natural instruments, and may simply be terminal comprising operating elements such as buttons.

In addition, while semi-automatic performance is performed in the present embodiment, the present invention need not be limited to this arrangement, and automatic performance may be performed instead. Furthermore, the respective performance terminals 2 need not play different performance parts, and may alternatively be arranged to play the same performance part.

Figure 2:
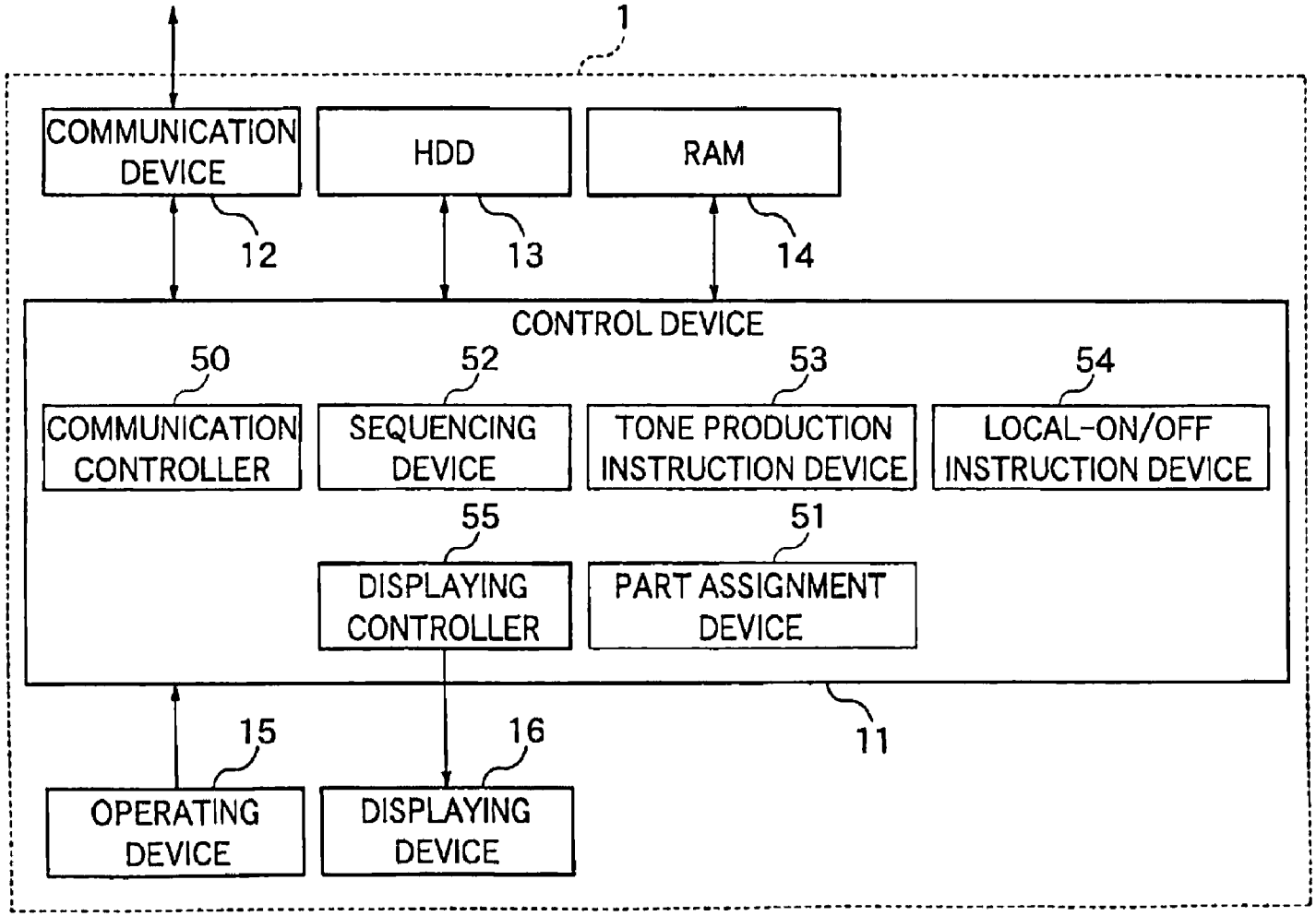
FIG. 2 is a block diagram showing an arrangement of a controller.

FIG. 2 is a block diagram showing an arrangement of the controller 1. As shown in FIG. 2, the controller 1 comprises a communication device 12, a control device 11, an HDD 13, a RAM 14, an operating device 15, and a displaying device 16. The communication device 12, the HDD 13, the RAM 14, the operating device 15 and the displaying device 16 are connected to the control device 11.

The communication device 12 is a circuit that communicates with the performance terminals 2, and comprises a USB interface. A MIDI interface box 3 is connected to the USB interface. The communication device 12 communicates with the six performance terminals 2 via the MIDI interface box 3 and MIDI cables.

The HDD 13 stores operation programs of the controller 1, and musical piece data, consisting of a plurality of performance parts, corresponding to a plurality of ensembles. Operation programs include an application (performance control program) for performing semi-automatic performance at each of the performance terminals 2. Musical piece data is created as standard MIDI in advance based on the MIDI standard, and is stored in the HDD 13 of the controller 1. An example of musical piece data is shown in FIG. 3.

As shown in FIG. 3, musical piece data consists of a plurality of performance parts, and includes identification information (part IDs) which identify each performance part and performance information (performance data as defined in the present invention) for each performance part. Musical piece data may be arranged to be stored prior to shipment, or to be stored after shipment by downloading using the communication device 12 from an external apparatus (not shown) via a network. In addition, data corresponding to a plurality of ensembles need not be stored, and data corresponding to a single musical piece may be stored instead.

The RAM 14 functions as a work area for the control device 11, and temporarily stores the above-mentioned program or data that are read out from the HDD 13.

The operating device 15 comprises, for instance, a mouse or a keyboard, and accepts operation instructions for the present performance system from a user (in most cases, the facilitator). The facilitator operates the operating device 15 to specify an ensemble to be performed or assign performance parts to the respective performance terminals 2, and the like. In addition, the facilitator uses the operating device 15 to instruct commencement of performance of the specified ensemble or to instruct suspension of performance of the ensemble currently being performed. Operations for instructing commencement or suspension of performance will be described later.

The displaying device 16 is composed of a so-called display (monitor) or the like. The displaying manner is controlled by the control device 11 (by a displaying controller 55 to be described later).

The control device 11 reads out an operation program stored in the HDD 13 and deploys the program in the RAM 14 that is a work memory. The control device 11 comprises function sections including a communication controller 50, a part assignment device 51, a sequencing device 52, a tone production instruction device 53, a local-on/off instruction device 54, and the displaying controller 55.

The communication controller 50 controls communication performed by the communication device 12.

The part assignment device 51 executes a process that sets part assignment setting to the sequencing device 52 by default. More specifically, a table that associates part IDs with MIDI ports as shown in FIG. 4 is stored (for instance, prior to shipment) in the HDD 13. In this case, a MIDI port is used as an ID (identifier) that is unique to each of the performance terminals 2 connected thereto. In other words, each of the performance terminals 2 is assigned a terminal ID which is associated to an assigned performance part and registered in the table. A terminal ID is a unique identifier, and indicates an order among the terminal IDs "0 to 5" as described above. The part assignment device 51 references this table to acquire a default part assignment setting. The sequencing device 52 also stores a table similar to that shown in FIG. 4, and the part assignment device 51 sets a part assignment by registering the part assignment in this table.

In addition, the part assignment device 51 executes a process for changing the part assignment setting of the sequencing device 52 according to instructions issued by the user using the operating device 15.

Based on the part assignment setting, the sequencing device 52 reads out a performance part corresponding to the performance terminal 2 that is the transmitting source of the performance operation signal, and performs sequencing (determination of pitch and length or the like of each note) on the read-out performance part according to instructions on tempo and timing indicated by the performance operation signal. Specific contents of this sequencing will be described later in detail.

The tone production instruction device 53 corresponds to the automatic performance control device as defined in the present patent application, and transmits the pitch and length or the like of each note determined by the sequencing device 52 as tone instruction data to the performance terminals 2.

The local-on/off instruction device 54 executes a local-on/off control process. During the local-on/off control process, when an instruction to change the sequencing device 52 to a performance state is inputted using the operating device 15, the local-on/off instruction device 54 transmits a control signal (local-on instruction message) that sets the performance terminals 2 to local-on mode to each of the performance terminals 2 via broadcast. In this case, a performance state refers to a state in which the sequencing device 52 is set to a part assignment setting by the part assignment device 51, and in which the sequencing device 52 may perform sequencing by reading out a performance part from the HDD 13 when a performance operation signal is inputted from a performance terminal 2.

During the local-on/off control process, when an instruction to terminate the performance state of the sequencing device 52 is inputted using the operating device 15 or when the performance of an ensemble of a single specified musical piece has been concluded, the local-on/off instruction device 54 transmits a control signal (local-off instruction message) that sets the performance terminals 2 to local-off mode to each of the performance terminals 2 via broadcast. The instructions for changing the sequencing device 52 to a performance state or terminating this performance state which are issued using the operating device 15 will be described later in detail. In addition, the local-on/off control process will be described later with reference to the flowchart shown in FIG. 9. The display controller 55 controls the displaying manner performed by the displaying device 16. The displaying controller 55 causes a main operation window W1 to be displayed on the displaying device 16 when the performance control program is activated.

Figure 5:
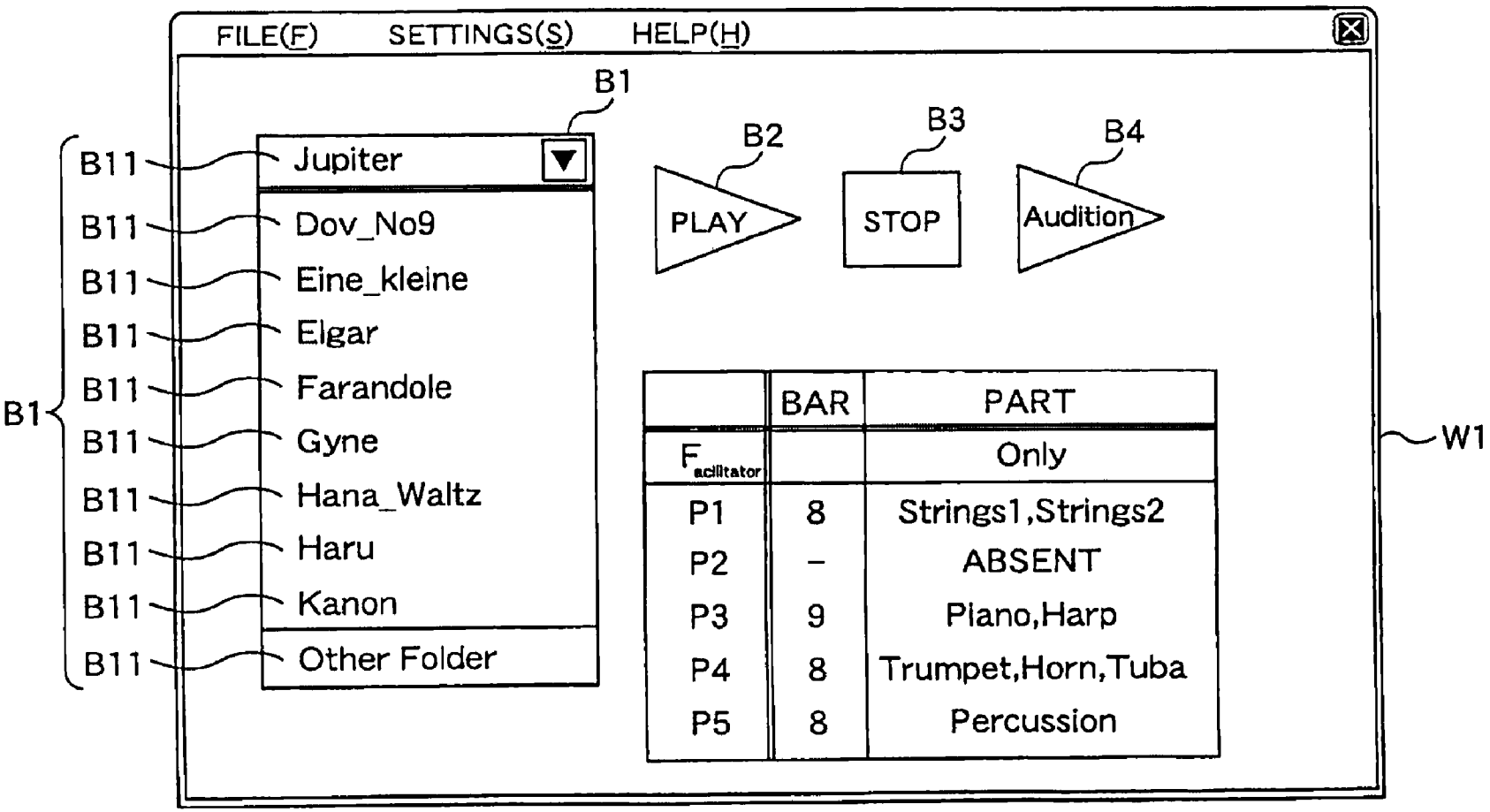
FIG. 5 is a view showing an example of a main operation window W.

FIG. 5 is a diagram showing an example of the main operation window W1.

A corresponding number of musical piece selection buttons B11 for a plurality of ensembles are displayed at the far left of the main operation window W1. These musical piece selection buttons B11 will be collectively referred to as the musical piece selection button group B1. The facilitator and the like select an ensemble by operating a mouse and clicking on the musical piece selection button of the name of the ensemble to be selected.

In addition, a PLAY button B2, a STOP button B3 and an AUDITION button B4 are displayed in this order from top to bottom in the upper right of the main operation window W1.

When the facilitator and the like operates the mouse and clicks on the PLAY button B2, the sequencing device 52 is set to a performance state. At the same time, in the present embodiment, the local-on/off instruction device 54 uses the communication controller 50 to transmit a control signal (local-off instruction message) that sets the mode of the performance terminals 2 to local-off.

In addition, during the performance process, when the facilitator and the like operates the mouse and clicks on the STOP button B3, the performance state of the sequencing device 52 is terminated. At the same time, the local-on/off instruction device 54 uses the communication controller 50 to transmit a control signal (local-on instruction message) that sets the mode of the performance terminals 2 to local-on.

When the facilitator and the like operates the mouse and clicks on the AUDITION button B4, the sequencing device 52 commences an audition process that allows each performer to audition the selected ensemble. The audition process may be terminated by operating the mouse and pressing the STOP button B3.

Part assignment settings (in the present example, the respective assignment settings of: "Strings 1", "Strings 2", "Piano", "Harp", "Trumpet", "Horn", "Tuba" and "Percussion") of the "Facilitator F (terminal ID 0)" and "P1 to P5 (terminal IDs 1 to 5)", as well as absence settings of each performer, namely, "Facilitator F" and "P1 to P5" are displayed at the bottom right of the main operation window W1.

Buttons of "File (F)", "Settings (S)" and "Help (H)" are displayed in this order from left to right at the extreme top of the main operation window W1. When "Settings (S)" is clicked, items such as "Select MIDI keyboard", "Manually assign performance part" and "Set beat" are displayed. When "Select MIDI keyboard" is clicked, the displaying controller 55 displays a MIDI keyboard selection window W3, which will be described later. In addition, when "Manually assign performance part" is clicked, the displaying controller 55 displays a manual assignment window W2, which will be described later, onto the displaying device 16.

Furthermore, when "Set beat" is selected, the displaying controller 55 causes the displaying device 16 to display a window for setting a meter (the above-described specific operation timing).

The meter is set when the facilitator or the like selects a meter on this window. For instance, in the event that the meter is set to four when a musical piece data having a 4/4 time signature is to be played, key depression will be set to be performed on every beat. In addition, by selecting a radio button corresponding to two beats, key depression will be performed on every other beat. In other words, the key depression timings will be the first and third beats. In this case, when a note-on message and a note-off message is transmitted from the performance terminal 2, the tone production instruction device 53 sends back tone instruction data corresponding to two beats. In other words, one key depression will result in two beats being played.

Furthermore, a "x" icon is displayed in the top right corner of the main operation window W1. Clicking on the "x" icon terminates display of the main operation window W1, thereby concluding the performance control program.

Figure 6:
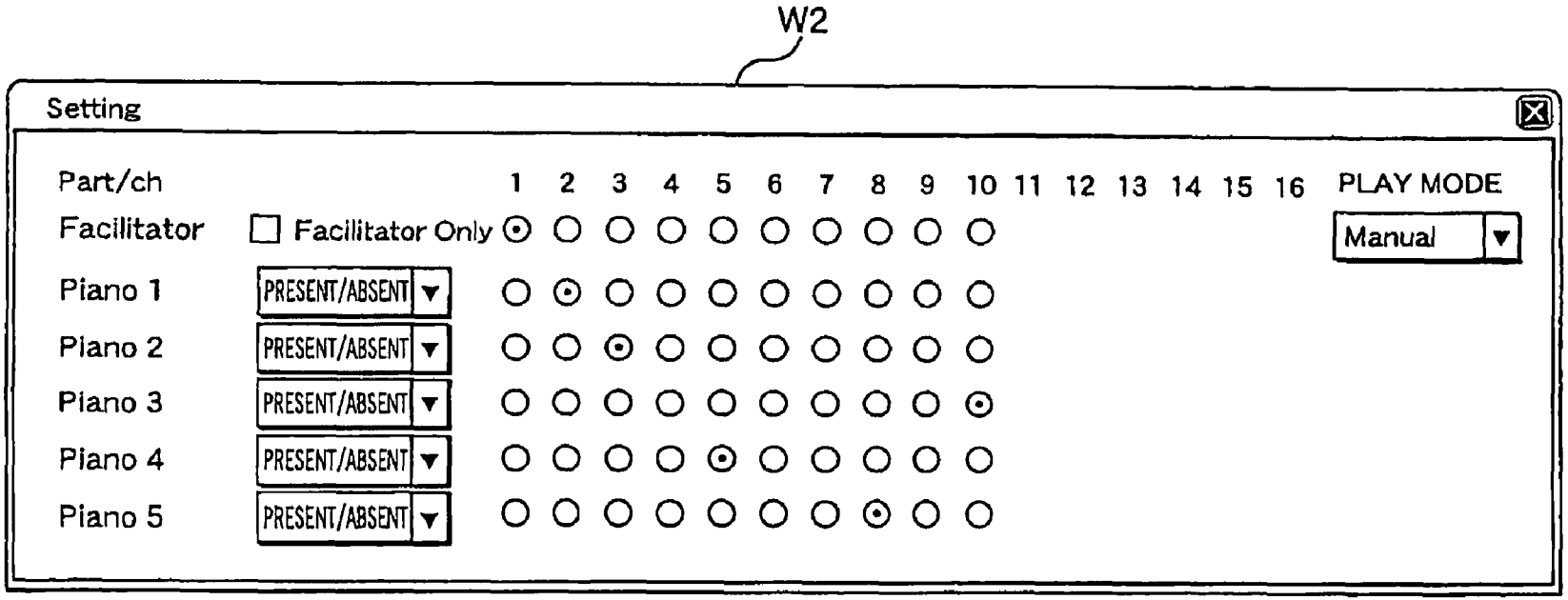
FIG. 6 is a view showing an example of a manual assignment window.

FIG. 6 is a diagram showing an example of the manual assignment window W2.

In the manual assignment window W2, a pull down menu for selecting present/absent and radio buttons for assigning performance parts are, respectively, displayed for the "Facilitator (same as the Facilitator F described above)" and "Pianos 1 to 5 (same as P1 to P5 described above)". The "Facilitator" and "Pianos 1 to 5" are, respectively, associated with MIDI ports of the MIDI interface box 3. Playing terminals 2 will be associated with the "Facilitator" and "Pianos 1 to 5" when the performance terminals 2 are, respectively, connected to each MIDI port.

Figure 7:
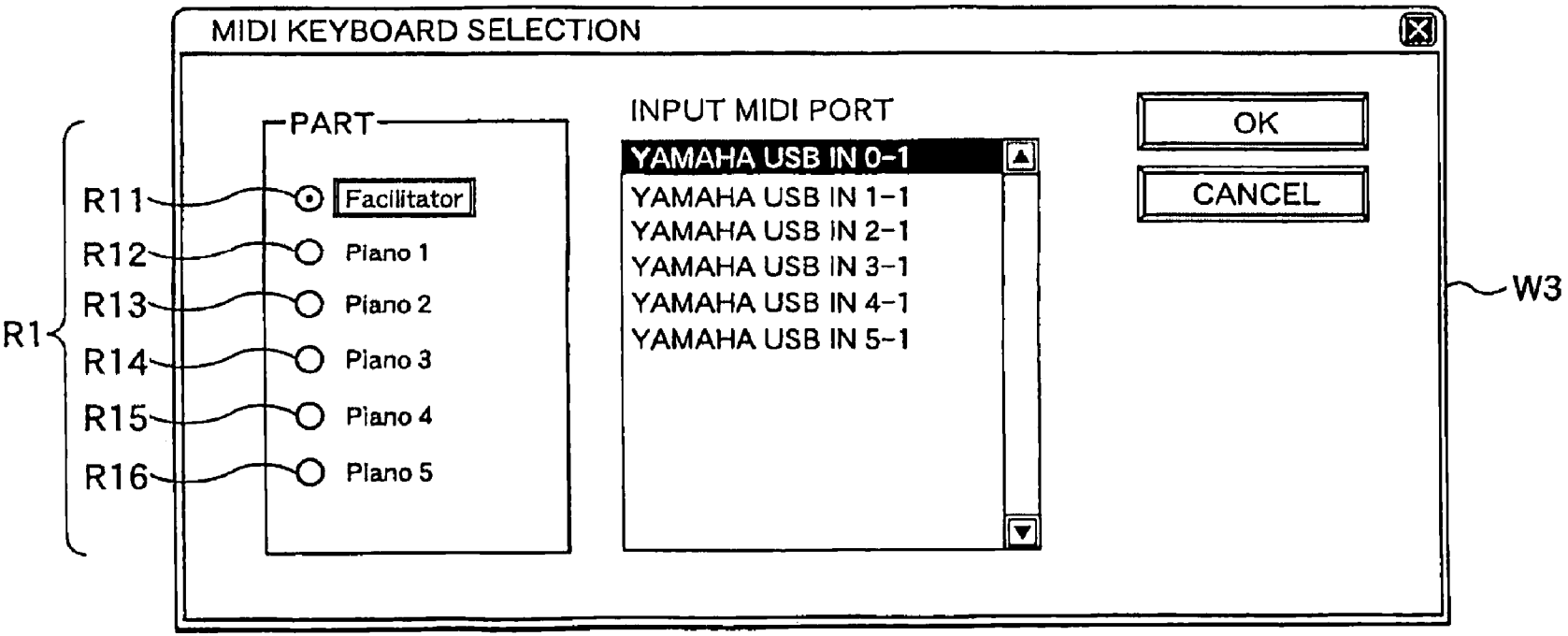
FIG. 7 is a view showing a MIDI port selection window.

The facilitator may also manually select MIDI ports to be associated with the "Facilitator" and the "Pianos 1 to 5" on the MIDI keyboard selection window W3, as shown in FIG. 7.

Performance parts or MIDI ports may be manually selected in cases such as exemplified below. Performance parts or MIDI ports may be set according to characteristics (tastes, habits, performance accuracy and the like) of the performers of the performance terminals 2 or the facilitator's intended objective of ensemble (focus on melody, intentionally assign a rhythmic performance part to a performer who is uncomfortable with rhythmic ensembles, and the like).

In FIG. 6, the facilitator operates the mouse to select and input the present/absent pull down menu according to the attendance or absence of students. The number of displayed radio buttons corresponds to the product of the number of performance parts of the selected ensemble and the number of performance terminals 2 to which "present" has been set. In this arrangement, radio buttons will not be displayed for performance terminals for which "absent" has been selected from the pull down menu, and no performance parts will be assigned to such performance terminals.

In the example shown in FIG. 6, the musical piece data of the selected ensemble includes performance parts 1 to 10. Upon selection of the ensemble, the performance parts 1 to 10 will be automatically assigned to the performance terminals 2 that are present according to a default setting. At this point, the user (facilitator) operating the controller 1 may also manually select respective performance parts to preferred performance terminals by selecting radio buttons.

Normally, by default, a performance part will not be assigned to the "Facilitator". However, a performance part may be assigned thereto in order to instruct operation timings to the performers of the other performance terminals. In addition, by selecting the "Facilitator Only" check box, all performance parts will be assigned to the "Facilitator".

Arrangements of the controller 1 and the performance terminals 2 sill now be described in detail.

Figure 8:
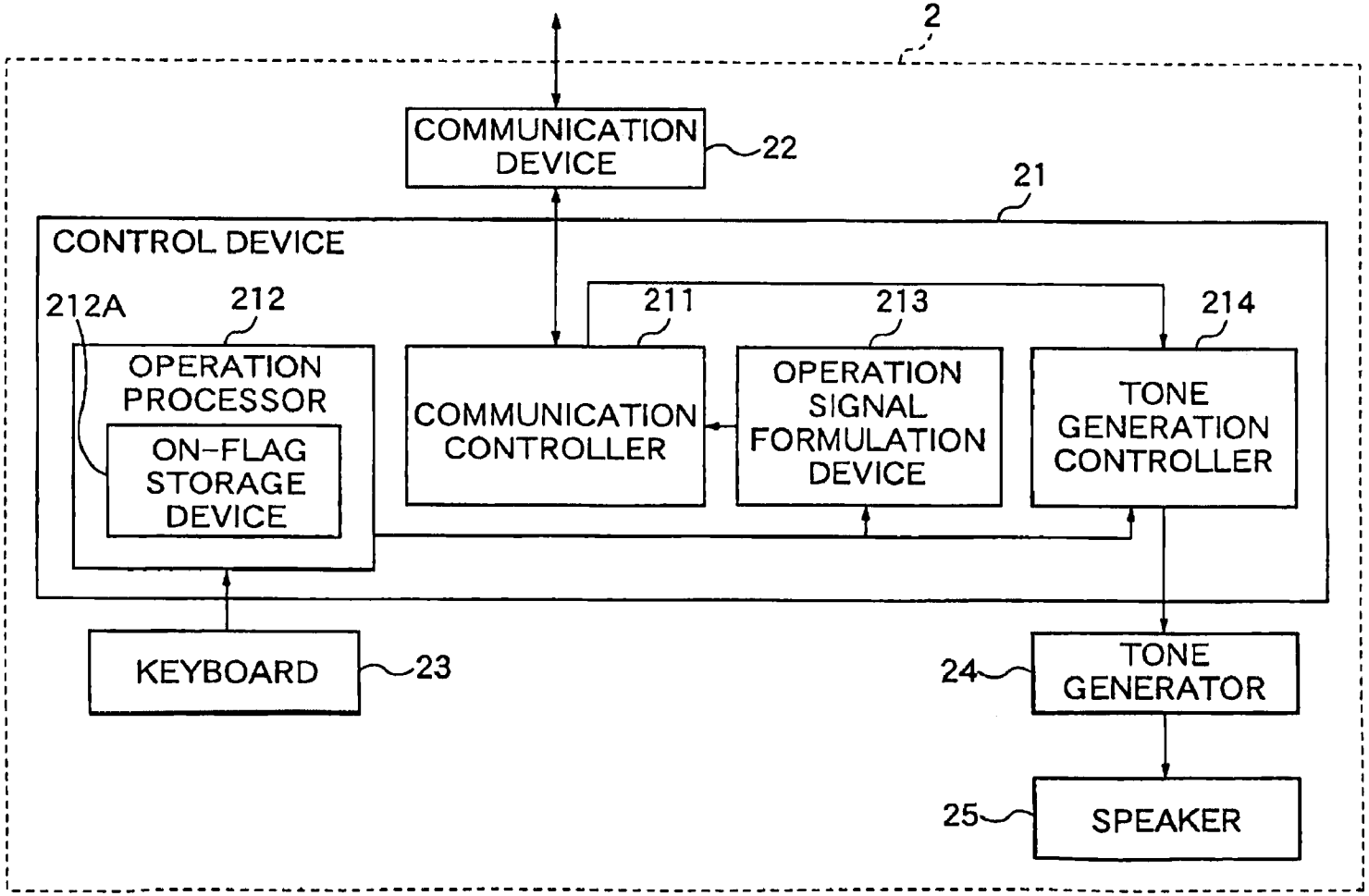
FIG. 8 is a block diagram showing an arrangement of a performance terminal.

FIG. 8 is a block diagram showing an arrangement of the performance terminal 2. As shown in FIG. 8, the performance terminal 2 comprises a control device 21, a communication device 22, a keyboard 23 that is an operating element, a tone generator 24, and a speaker 25. The communication device 22, the keyboard 23 and the tone generator 24 are connected to the control device 21. In addition, the speaker 25 is connected to the tone generator 24.

The communication device 22 is a MIDI interface, and communicates with the controller 1 via a MIDI cable. The keyboard 23 has, for instance, 61 or 88 keys, and may be played at a range of five to seven octaves. However, in the present performance system, only data representing note-on/note-off messages and intensity of key depression (velocity) will be used without distinction of keys. More specifically, a sensor that detects on/off and a sensor that detects intensity of key depression are built into each key. The keyboard 23 outputs a performance operation signal to the control device 21 (an operation processor 212 to be described later) according to the operation mode (which key was depressed at what level of intensity or the like) of each key.

The tone generator 24 generates a tone waveform according to the control of the control device 21 (a tone controller 214 to be described later), and outputs the tone waveform as an audio signal to the speaker 25. The speaker 25 reproduces the audio signal inputted from the tone generator 24 to produce a tone. The tone generator and the speaker need not be built into the performance terminal 2. Instead, the tone generator and the speaker may be connected to the controller 1, and tones may be reproduced at a location that differs from the performance terminal 2. In this case, while a plurality of tone generators corresponding to the number of the performance terminals 2 may be connected to the controller 1, a single tone generator may be used instead. When the same number of tone generators as that of the performance terminals 2 are connected to the controller 1, the controller 1 may assign performance parts of the musical piece data by respectively associating a tone generator to the respective performance terminals 2.

The control device 21 performs overall control of the performance terminal 2, and functions as a communication controller 211, an operation processor 212, a performance operation signal formulation device 213 and a tone controller 214.

The communication controller 211 controls communication performed by the communication device 22 with the controller 1.

The operation processor 212 is connected to the keyboard 23, and signals corresponding to key depressions are inputted thereto. The operation processor 212 is provided with an on-flag storage device 212A that stores local-on flags. Hereinafter, a state in which a local-on flag is stored in the on-flag storage device 212A will be described as a state in which "a local-on mode has been set", and a state in which a local-on flag is not stored will be described as a state in which "a local-off mode has been set".

Regardless of whether local-on or local-off has been set, when the above-described signal corresponding to a key depression is inputted, the operation processor 212 inputs the signal to the performance operation signal formulation device 213. In addition, the operation processor 212 inputs the signal to the tone controller 214 only when the local-on mode has been set. This means that a tone will not be produced when the local-off mode has been set.

The operation processor 212 executes a mode switching process. In the mode switching process, when a local-on instruction message is inputted from the controller 1 via the communication device 22 and the communication controller 211, the operation processor 212 stores a local-on flag in the on-flag storage device 212A (switches mode to local-on mode). In addition, when a local-off instruction message is inputted, the operation processor 212 deletes the local-on flag stored in the on-flag storage device 212A (switches mode to local-off mode). The mode switching process will be described later with reference to FIG. 10.

More specifically, since a local-off instruction message will be inputted, when the controller 1 activates the performance control program and issues a performance commencement instruction, the mode will be set to local-off. Therefore, since a tone of a key depressed by the user will be produced, inhibition of the performance of the performance terminals 2 controlled by the controller 1 may be effectively prevented. In addition, operations for switching to a local-off setting will no longer be required for each of the performance terminals 2, thereby improving the operability.

Furthermore, when termination of performance is instructed or when the performance of a selected musical piece is concluded, since a local-on instruction message will be inputted, the operation processor 212 will be set to local-on. Therefore, since successive switching to a local-on setting will no longer be required every time performance is concluded, thereby improving the operability.

When a signal corresponding to a key depression is inputted from the operation processor 212, the performance operation signal formulation device 213 forms a performance operation signal (note-on/note-off message) corresponding to the signal and outputs the formed signal to the communication controller 211. The communication controller 211 transmits the inputted performance operation signal to the controller 1 via the communication device 22.

When tone data is received via the communication device 22 and the communication controller 211, the tone controller 214 inputs the tone data to the tone generator 24. This enables semi-automatic performance by the controller 1.

In addition, as described above, when the operation processor 212 is set to local-on, a signal corresponding to a key depression is inputted from the operation processor 212 to the tone controller 214. In this case, the tone controller 214 controls the tone generator 24 so that playing corresponding to the inputted signal is realized. More specifically, the tone controller 214 forms a note-on/note-off message that instructs production and muting of a tone with a tone pitch corresponding to the signal, and inputs the message to the tone generator 24. As a result, when the local-on mode is set, playing may be achieved through playing operations on the keyboard 23, and the performance terminal 2 may be used as an ordinary electronic musical instrument.

Next, operations for enabling the above-described performance system to perform an ensemble will be described with reference to FIGS. 5 and 8.

At the controller 1, when the control device 15 accepts an instruction from a user (particularly, the facilitator), the control device 11 activates the performance control program. Subsequently, the control device 11 displays a main operation window W such as that shown in FIG. 5 on the display device 16. When the control device 15 accepts a selection of an ensemble (musical piece data) from among a plurality of ensembles by the user (particularly, the facilitator), the selected musical piece data is notified to the part assignment device 51.

The controller 1 references the header portion of the musical piece data of the selected ensemble among the plurality of musical piece data stored in the HDD 13, acquires information on what kind of performance parts are included in the data, and for each acquired performance part, sets a part assignment to the sequencing device 52 using the part assignment device 51. When selection operations are not accepted, performance parts are acquired based on default performance data and a performance part assignment process is executed.

When the PLAY button B2 is depressed, the controller 1 enters a preparatory state (performance state) for reading out musical piece data from the HDD 13 to the RAM 14 and performing performance operations. Once this state is achieved, performers of the respective performance terminals 2 are able to perform. In the present performance system, operation timings are instructed through conducting performed by the facilitator (ensemble leader) using the hands or through playing operations performed by the facilitator, and a plurality of performers perform playing operations to the instructed operation timings. In other words, since each user performs to instructions from the facilitator instead of simply performing to a model performance (mechanical demo performance), the users may gain a real sense of performing an authentic ensemble.

Operations of the performance system during semi-automatic performance will now be described. When each user depresses the operating element (keyboard) 23 of the performance terminal 2 with a finger, a signal corresponding to the depression is inputted to the performance operation signal formulation device 213 via the operation processor 212. The performance operation signal formulation device 213 forms a note-on message (performance operation signal) corresponding to this signal, and transmits the message to the controller 1 via the communication controller 211. The note-on message includes information such as intensity of key depression (velocity). When the keyboard 23 is released (when the finger is removed), the control device 21 transmits a note-off message (performance operation signal) to the controller 1.

At the controller 1, based on the performance operation signal (note-on message, note-off message) received from the performance terminal 2, the sequencing device 52 sequences musical piece data corresponding to a predetermined length (for instance, for one beat in a case where two beats are set to each measure, a length of half a measure) among the performance part assigned to that performance terminal 2.

More specifically, when a note-on message is inputted, the sequencing device 52 reads out performance information corresponding to the above-mentioned predetermined length from the relevant performance part among the musical piece data, and determines a timing, a tone color, an effect, a tone pitch variation and the like at which a tone is to be produced.

In other words, when the sequencing device 52 determines tone production intensity from the velocity information included in the note-on message, such tone production is determined by multiplying information indicating volume that is included in the performance information of the read-out musical piece data with the velocity information. Therefore, a strength expression corresponding to the intensity of depression of the keyboard by each user is added to volume information, included in musical piece data, which takes into consideration a volume expression (strength of note) within the musical piece to determine a tone intensity.

In addition, the sequencing device 52 determines a tempo or a tone length of each note based on the time elapsed from the reception of a note-on message to the reception of a note-off message. More specifically, the sequencing device 52 measures the time elapsed from the input of the note-on message to the input of the note-off message. For a tone that is produced first in the read-out musical piece data having a predetermined length, the sequencing device 52 determines the time elapsed from the input of the note-on message to the input of the note-off message as the tone length. For tones to be subsequently produced, based on the measured duration of time, the sequencing device 52 determines a tempo of the beat based on the measured duration of time as well as tone lengths of each note.

While the sequencing device 52 may determine the duration of time from note-on to note-off (referred hereinafter as "GateTime") as the tempo and tone length, a tempo may be determined as follows. For a plurality of key depressions (from the last to several depressions prior thereto), a GateTime moving average is calculated, and weighting based on time is performed thereon. In other words, the last key depression will be most heavily weighted, and the further back a key depression is in time, the lighter the weighting. By determining a tempo in this manner, sudden changes in tempo will not occur even when the GateTime changes significantly at a certain key depression. As a result, tempo variations may be performed in a smooth manner according to the flow of the musical piece.

The tone production instruction device 53 generates tone production instruction data based on the sequence provided by the sequencing device 52. The tone production instruction data instructs a timing, a tone length, an intensity, a tone color, an effect and a tone pitch variation (pitch bend) at which a tone is to be produced, as well as a tempo and the like. The communication device 12 transmits the generated tone production instruction data to the performance terminal 2.

At the performance terminal 2, the tone generation controller 214 receives the above-mentioned tone production instruction data via the communication device 22, and instructs the tone generator 24 to generate a tone waveform. The tone generator 24 generates a tone waveform, and reproduces a tone through the speaker 25. The above processes are repeated every time each user depresses a keyboard, and a musical piece may be performed by, for instance, depressing a keyboard at every beat.

As described above, until a note-off message is inputted, an instruction will be issued to generate the tone that is first produced in a measure without modification. Therefore, the tone generator 24 will continuously output the same note until the finger of the user is removed from the keyboard, thereby causing a performance expression (fermata) for sustaining a note to be achieved by the present performance system.

In addition, by determining a tempo from a GateTime moving average as described above, a performance expression such as described below may be realized by the tone generator 24. For instance, when only a certain key is depressed briefly, the sequencing device 52 determines a short tone length for each note for the corresponding beat. Meanwhile, when a certain key is depressed in an unhurried manner, the sequencing device 52 determines a long tone length for each note for the corresponding beat. This enables the tone generator 24 to realize a performance expression (staccato) in which each note is sounded in a distinctly separate manner without significant variation in tempo, or a performance expression (tenuto) in which notes are sustained without significant variation in tempo.

While the present embodiment is arranged so that the same note-on message or note-off message will be transmitted to the controller 1, keys responsive to staccato or tenuto as described above may be separated from unresponsive keys on the keyboard 23. The controller 1 may be arranged to vary tone length while maintaining tempo only when a note-on message or a note-off message is inputted from a specific key (for instance, E3).

Although the above-described process of the performance terminal 2 is executed when local-off is set, the following process may additionally be executed when local-on is set. When a signal indicating a key depression is inputted from the keyboard 23, the operation processor 212 inputs the signal to the tone generation controller 214. The tone generation controller 214 generates a note-on/note-off message according to the inputted signal, and transmits the message to the tone generator 24. As a result, local performance may be achieved.

In the present embodiment, a performance operation signal is transmitted to the controller 1 even when local-on is set. In this case, since the sequencing device 52 is not in a performance state, the controller 1 does not generate tone data even when receiving the performance operation signal. Therefore, tone data will not be transmitted to the performance terminals 2. However, when the mode is set to local-on instead of this arrangement, the performance terminals 2 may be arranged not to generate and output performance operation signals.

Figure 9:
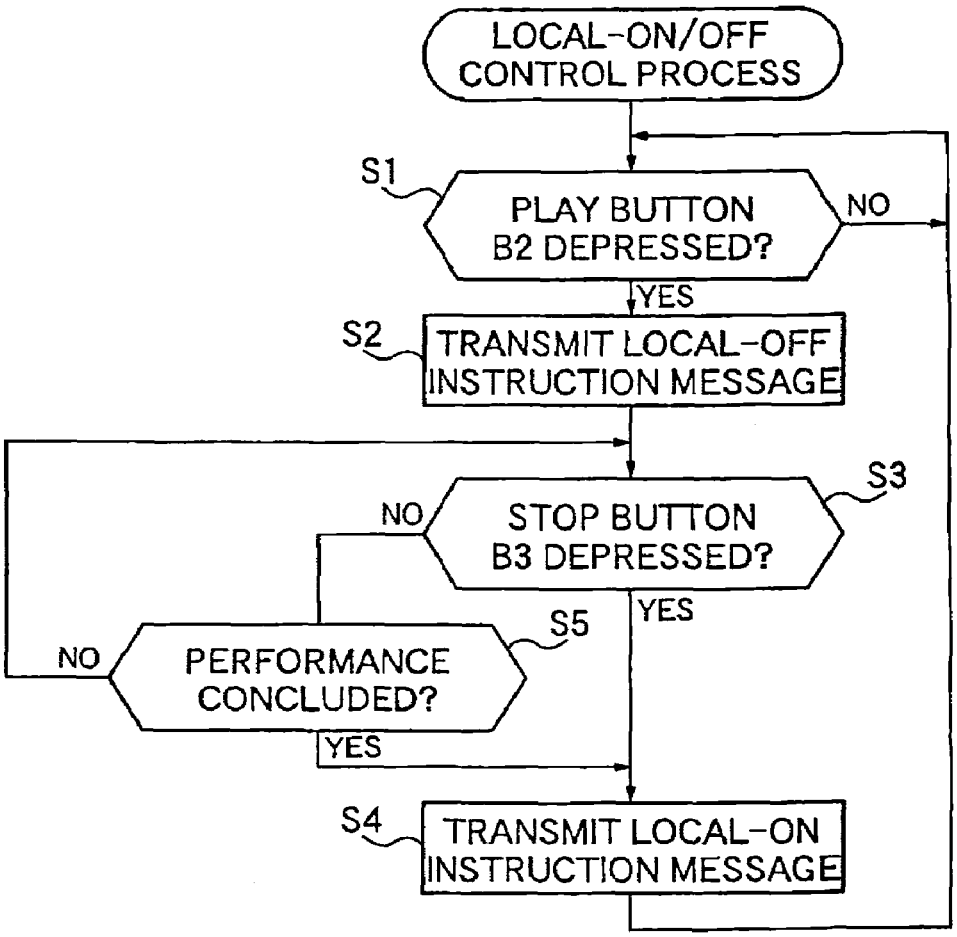
FIG. 9 is a flowchart showing procedures of a local-on/off control process executed by the controller.

FIG. 9 is a flowchart showing procedures of the local-on/off control process executed by the controller 1. The local-on/off instruction device 54 repeatedly determines whether or not the PLAY button B2 has been pressed until such a determination is made (step S1). When it is determined that the PLAY button B2 has been pressed (YES in step S1), the local-on/off instruction device 54 reads out a local-off instruction message from the HDD 13 and inputs the message to the communication controller 50 (step S2). The communication controller 50 transmits the local-off instruction message to the respective performance terminals 2 via broadcast.

Subsequently, the local-on/off instruction device 54 determines whether or not the STOP button B3 has been pressed (step S3). When it is determined that the STOP button B3 has been pressed (YES in step S3), the local-on/off instruction device 54 reads out a local-on instruction message from the HDD 13 and inputs the message to the communication controller 50 (step S4). The communication controller 50 transmits the local-on instruction message to the respective performance terminals 2 via broadcast. The local-on/off instruction device 54 then concludes the present process.

When it is determined that the STOP button B3 has not been pressed (NO in step S3), the local-on/off instruction device 54 determines whether or not the performance of a selected musical piece has been concluded (step S5). When it is determined that the performance of a selected musical piece has not been concluded (NO in step S5), the local-on/off instruction device 54 returns the present process to step S3. On the other hand, when it is determined that the performance of a selected musical piece has been concluded (YES in step S5), the local-on/off instruction device 54 executes the process of step S4. As a result, a local-off instruction message is transmitted when the performance of a selected musical piece is concluded.

Figure 10:
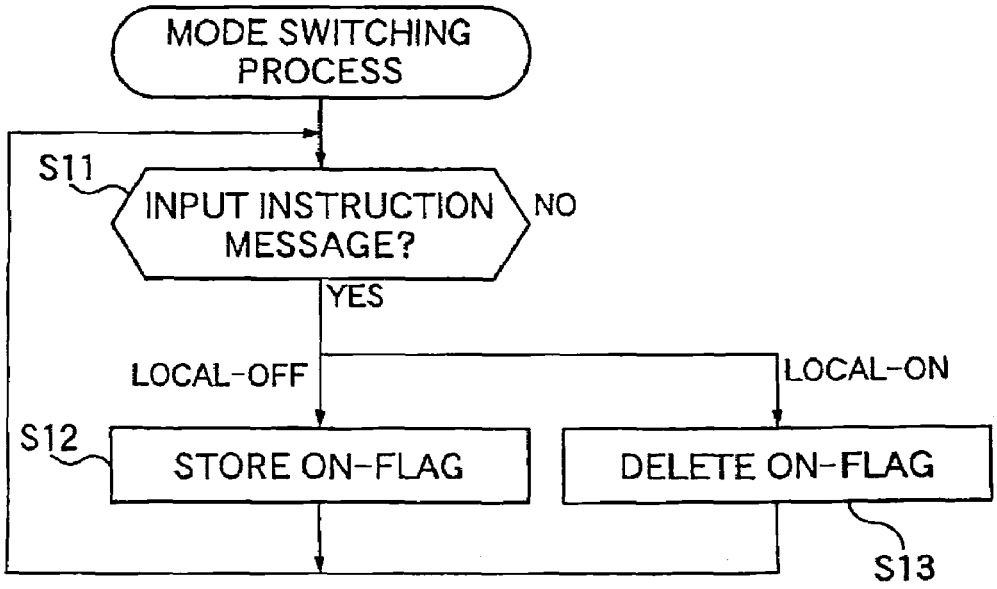
FIG. 10 is a flowchart showing an example of a mode switching process executed by the performance terminal.

FIG. 10 is a flowchart showing an example of a mode switching process executed by the performance terminal 2. First, the operation processor 212 repeatedly determines whether or not a local-on instruction message or a local-off instruction message has been inputted until such a determination is made (step S11).

When it is determined that a local-on instruction message or a local-off instruction message has been inputted (YES in step S11), in the event that the inputted signal is a local-on instruction message, the operation processor 212 stores a local-on flag in the on-flag storage device 212A (step S12). In addition, in the event that the inputted signal is a local-off instruction message, the operation processor 212 deletes the local-on flag stored in the on-flag storage device 212A (step S13), followed by the operation processor 212 returning the present process to step S11.

According to the above arrangement, in the present embodiment, when the controller 1 accepts an operation (depression of the PLAY button B2) that changes the sequencing device 52 to a performance state, the performance terminals 2 automatically enter a local-off state. In addition, when the controller 1 accepts an operation (depression of the STOP button B3) that cancels the performance state of the sequencing device 52, the performance terminals 2 automatically enter a local-on state. As a result, performers of the respective performance terminals 2 will no longer be required to individually switch local-on/off settings of the performance terminals 2 upon commencement or conclusion of semi-automatic performance of the performance terminals 2, thereby improving the operability of switching local-on/off settings.

It is to be understood that the object of the present invention may also be accomplished by supplying a computer, for example, the EC 100 our the control apparatus 400 with a storage medium in which a program code of software which realizes the functions of the above described embodiment is stored, and causing a computer (or CPU or MPU) of the system or apparatus to read out and execute the program code stored in the storage medium.

In this case, the program code itself read from the storage medium realizes the functions of any of the embodiments described above, and hence the program code and the storage medium in which the program code is stored constitute the present invention.

Examples of the storage medium for supplying the program code include a floppy (registered trademark) disk, a hard disk, a magnetic-optical disk, a CD-ROM, a CD-R, a CD-RW, DVD-ROM, a DVD-RAM, a DVD-RW, a DVD+RW, a magnetic tape, a nonvolatile memory card, and a ROM. Alternatively, the program may be downloaded via a network.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

What is claimed is:

1. A performance system comprising a plurality of playing terminals and a controller capable of communicating with each other, wherein said performance terminal is comprised of:

a performance operation device adapted to generate performance data according to operations of a performer;

a tone generator adapted to generate a tone based on the performance data; and a control device adapted to transmit performance data generated by said performance operation device to said controller, execute a communication process for inputting performance data received from said controller to said tone generator, and execute a mode switching process for switching between a local-on mode in which said performance operation device inputs the generated performance data to said tone generator to generate a tone and a local-off mode in which said performance operation device does not input the generated performance data to said tone generator, said controller is comprised of:

a storage device adapted to store musical piece data consisting of a plurality of performance parts and including a plurality of performance data strings for each of the performance parts; and an automatic performance control device adapted to determine a tempo and/or a beat timing of automatic performance based on performance data received from each of said playing terminals, read out a performance data string for each of the performance parts from the musical piece data, assigning the read-out performance data string for each of the performance parts to each of the performance terminals, and transmit the assigned performance data string to each of said playing terminals individually, and wherein said automatic performance control device of said controller is adapted to transmit a local-off instruction message to all said playing terminals upon commencement of automatic performance according to the musical piece data, and said control device of said playing terminal is adapted to switch the mode to a local-off mode upon receiving the local-off instruction message from said controller.

2. A performance system according to claim 1, wherein said automatic performance control device of said controller is adapted to transmit a local-on instruction message to said performance terminal upon conclusion or termination of automatic performance according to said musical piece data, and said control device of said performance terminal is adapted to switch the mode to a local-on mode upon receiving the local-on instruction message from said controller.

3. A controller capable of mutually communicating with a plurality of playing terminals, said controller comprising:

a storage device adapted to store musical piece data consisting of a plurality of performance parts and including a plurality of performance data strings for each of the performance parts; and an automatic performance control device adapted to determine a tempo and/or a beat timing of automatic performance based on performance data received from each of said playing terminals, read out a performance data string for each of the performance parts from the musical piece data, assigning the read-out performance data string for each of the performance parts to each of the performance terminals, and transmit the assigned performance data string to each of said playing terminals individually, wherein said automatic performance control device is adapted to transmit a local-off instruction message to all said playing terminals upon commencement of automatic performance according to the musical piece data.

4. A controller according to claim 3, wherein said automatic performance control device is adapted to transmit a local-on instruction message to said performance terminal upon conclusion or termination of automatic performance according to said musical piece data.

5. A non-transitory computer readable medium including a program that causes a controller which is equipped with a storage device for storing musical piece data consisting of a plurality of performance parts and including a plurality of performance data strings for each of the performance parts, and is capable of mutually communicating with a performance terminal, to execute:

an automatic performance process for determining a tempo and/or a beat timing of automatic performance based on performance data received from each of said playing terminals, reading out a performance data string for each of the performance parts from said musical piece data, assigning the read-out performance data string for each of the performance parts to each of the performance terminals and transmitting the assigned performance data string to each of said playing terminals individually; and a local-off instruction process for transmitting a local-off instruction message to all said playing performance terminals upon commencement of automatic performance according to the musical piece data.

6. A program according to claim 5, which causes said controller to execute a local-on instruction process for transmitting a local-on instruction message to said performance terminal upon conclusion or termination of automatic performance according to the musical piece data.

* * * * *